US008439660B2

(12) United States Patent
Masuda et al.

(10) Patent No.: US 8,439,660 B2
(45) Date of Patent: May 14, 2013

(54) SCREW COMPRESSOR HAVING A SECOND MESHING BODY WITH AT LEAST ONE PROJECTION NON-UNIFORMLY ARRANGED WITH RESPECT TO THE OTHER PROJECTIONS IN CIRCUMFERENTIAL DIRECTION

(75) Inventors: Masanori Masuda, Sakai (JP); Mohammod Anwar Hossain, Sakai (JP); Tsuyoshi Fukunaga, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 612 days.

(21) Appl. No.: 12/673,280

(22) PCT Filed: Aug. 11, 2008

(86) PCT No.: PCT/JP2008/064415

§ 371 (c)(1),
(2), (4) Date: Feb. 12, 2010

(87) PCT Pub. No.: WO2009/022680

PCT Pub. Date: Feb. 19, 2009

(65) Prior Publication Data

US 2012/0027634 A1 Feb. 2, 2012

(30) Foreign Application Priority Data

Aug. 13, 2007 (JP) ..... 2007-210795

(51) Int. Cl.

| | |
|---|---|
| ***F03C 4/00*** | (2006.01) |
| ***F04C 2/00*** | (2006.01) |
| ***F04C 18/00*** | (2006.01) |

(52) U.S. Cl.
USPC ..... 418/195; 418/197

(58) Field of Classification Search ..... 418/194, 418/195, 197, 201.1, 201.3; 74/425, 458, 74/462

See application file for complete search history.

(56) References Cited

U.S. PATENT DOCUMENTS

| | | | |
|---|---|---|---|
| 6,398,532 | B1 | 6/2002 | Zha et al. |
| 6,896,501 | B2 | 5/2005 | Ueno et al. |
| 2004/0037730 | A1 | 2/2004 | Ueno et al. |

FOREIGN PATENT DOCUMENTS

| | | | |
|---|---|---|---|
| CN | 1411538 | A | 4/2003 |
| JP | 60-17284 | A | 1/1985 |
| JP | 08-074764 | A | 3/1996 |
| JP | 2002-202080 | A | 7/2002 |
| JP | 2003-042094 | A | 2/2003 |
| JP | 3807922 | B | 8/2006 |
| JP | 3840899 | B | 11/2006 |

OTHER PUBLICATIONS

Office Action of corresponding Chinese Application No. 200880102783.7 dated Nov. 10, 2011.

*Primary Examiner* — Theresa Trieu
(74) *Attorney, Agent, or Firm* — Global IP Counselors

(57) ABSTRACT

A screw compressor comprises a first meshing body and a second meshing body. The first meshing body has plural helical flutes disposed around a first rotating shaft. The second meshing body has plural projections or lobes disposed around a second rotating shaft. At least one of the projections or lobes is arranged non-uniformly with respect to the other projections or lobes in a circumferential direction of the second rotating shaft. The plural helical flutes are arranged to be meshable with the plural projections or lobes, in a circumferential direction of the first rotating shaft.

17 Claims, 7 Drawing Sheets

SCREW COMPRESSOR HAVING A SECOND MESHING BODY WITH AT LEAST ONE PROJECTION NON-UNIFORMLY ARRANGED WITH RESPECT TO THE OTHER PROJECTIONS IN CIRCUMFERENTIAL DIRECTION

CROSS-REFERENCE TO RELATED APPLICATIONS

This U.S. National stage application claims priority under 35 U.S.C. §119(a) to Japanese Patent Application No. 2007-210795, filed in Japan on Aug. 13, 2007, the entire contents of which are hereby incorporated herein by reference.

TECHNICAL FIELD

The present invention relates to a screw compressor.

BACKGROUND ART

Conventionally, there have been proposed various compressors for compressing a compression medium such as refrigerant in a refrigeration machine, and among these compressors, screw compressors have less vibration and noise than reciprocating compressors and are used for various purposes.

The twin screw compressor described in Japanese Patent Publication No. 8-74764 is equipped with a female rotor having helical flutes, a male rotor having helical lobes that mesh with the helical flutes in the female rotor, and a casing that houses the female rotor and the male rotor. The male and female rotors rotate while meshing inside the casing, whereby a compression medium is compressed inside an operation chamber (compression chamber) formed in the helical flutes, and is thereafter discharged from a discharge port in the casing.

In this twin screw compressor described in Japanese Patent Publication No. 8-74764, the operation chamber and a discharge channel are communicated through a notch before the operation chamber opens, so that the pressure difference between inside and outside is alleviated until the operation chamber opens, and the occurrence of pressure waves at the time when the operation chamber opens is controlled. Further, the time period of the start of communication is made irregular, whereby the interval of discharge operation that was a meshing frequency is made irregular and resonance of a discharge tube and structural body is prevented.

On the other hand, the single screw compressor described in Japanese Patent Publication No. 2002-202080 is equipped with a cylindrical screw rotor having plural helical flutes in its outer peripheral surface, at least one gate rotor that rotates while meshing with the screw rotor, and a casing that houses the screw rotor. A compression medium such as refrigerant is sent to the helical flutes in the screw rotor rotating inside the casing, and is compressed inside a space enclosed by the helical flutes, the teeth of the gate rotor and the casing, and is discharged from a discharge port in the casing.

SUMMARY

Technical Problem

However, the screw compressors described in Japanese Patent Publication Nos. 8-74764 and 2002-202080 are both equipped with a screw whose flutes and teeth are arranged equidistantly, so there is the problem that sound and vibration occur in accompaniment with compression torque variation arising as a result of compressing in equal intervals during one rotation of the screw.

For example, even if a notch for preliminary discharge is disposed as in Japanese Patent Publication No. 8-74764, randomizing the plural discharge timings that exist during one rotation to avoid resonance accompanying discharge operation is also conceivable. However, in this case also, the structure is not one that varies the compression timing itself, so timing pertaining to minimum torque does not shift simply as a result of maximum torque timing pertaining to torque variation shifting slightly, and there is the problem that resonance resulting from torque pulsation arises.

Further, means that disperse the frequency of blowing pulsation by making the fin pitch in a rotating fan an irregular pitch are also publicly known (see JP-A No. 2003-42094, etc.), but this technology relates to noise reduction of an axial flow fan itself and is difficult to apply to solving compression torque pulsation that becomes the main cause of vibration in a twin or single screw compressor.

It is an object of the present invention to provide a screw compressor that is capable of effectively reducing sound and vibration accompanying compression torque variation.

Solution to the Problem

A screw compressor of a first aspect of the invention comprises a first meshing body and a second meshing body. The first meshing body has plural helical flutes around a first rotating shaft. The second meshing body has plural projections or plural lobes around a second rotating shaft. At least one of the projections or at least one of the lobes is arranged non-uniformly with respect to the other projections or the other lobes respectively, in the circumferential direction of the second rotating shaft. The plural helical flutes are arranged to be meshable with the plural projections or the plural lobes, in the circumferential direction of the first rotating shaft.

Here, at least one of the projections or at least one of the lobes of the second meshing body is arranged non-uniformly with respect to the other projections or the other lobes respectively, in the circumferential direction of the second rotating shaft, and the plural helical flutes of the first meshing body are arranged to be meshable with the plural projections or the plural lobes, in the circumferential direction of the first rotating shaft. Thus, it is possible to significantly reduce compression torque variation that had arisen in the conventional screw whose teeth and flutes are arranged equidistantly and torque pulsation resulting from compression torque variation. As a result, it is possible to reduce sound and vibration accompanying compression torque variation. Moreover, it is possible to reduce sound and vibration arising in accompaniment with suction/discharge flow velocity variation or pressure pulsation.

A screw compressor of a second aspect of the invention is the screw compressor of the first aspect of the invention, wherein the first meshing body and/or the second meshing body are/is balanced in weight such that an unbalanced load acts thereon in a direction that is different from the direction in which the first rotating shaft and/or the second rotating shaft extends respectively.

Here, the first meshing body and/or the second meshing body are/is balanced in weight such that an unbalanced load acts thereon in a direction that is different from the direction in which the first rotating shaft and/or the second rotating shaft extends respectively, so axial load switching accompanying changes in the gas load inside the compression chamber formed by the first meshing body and the second meshing body can be avoided, and it becomes possible to avoid the occurrence of noise accompanying axial load switching.

A screw compressor of a third aspect of the invention is the screw compressor of the first or second aspect of the invention, wherein the number of the helical flutes has a relationship that it has a common divisor other than 1 with the number of the plural projections or the plural lobes.

Here, the number of the helical flutes has a relationship that it has a common divisor other than 1 with the number of the plural projections or the plural lobes, so sound and vibration can be reliably reduced, and design is easy.

A screw compressor of a fourth aspect of the invention is the screw compressor of any of the first to third aspects of the invention, wherein at least the non-uniformly arranged projections of the plural projections or at least the non-uniformly arranged lobes of the plural lobes are arranged symmetrically with respect to the second rotating shaft.

Here, at least the non-uniformly arranged projections of the plural projections or at least the non-uniformly arranged lobes of the plural lobes are arranged symmetrically with respect to the second rotating shaft, so rotational centrifugal force can be balanced, and so there can be provided an even lower vibration screw compressor.

A screw compressor of a fifth aspect of the invention is the screw compressor of any of the first to third aspects of the invention, wherein the center of gravity of the first meshing body and/or the second meshing body in a cross section perpendicular to the direction of the first rotating shaft and/or the second rotating shaft, coincides with the center of the rotation of the first rotating shaft (4, 105) and/or the second rotating shaft (8, 9, 106) respectively.

Here, the center of gravity of the first meshing body and/or the second meshing body in a cross section perpendicular to the direction of the first rotating shaft and/or the second rotating shaft, coincides with the center of the rotation of the first rotating shaft and/or the second rotating shaft respectively, so sound and vibration can be reduced.

A screw compressor of a sixth aspect of the invention is the screw compressor of any of the first to fifth aspects of the invention, wherein the screw compressor is a single screw compressor where the first meshing body is a screw rotor and the second meshing body is a gate rotor.

Here, the screw compressor is a single screw compressor where the first meshing body is a screw rotor and the second meshing body is a gate rotor, so it becomes possible to achieve significantly reducing compression torque variation, and it is possible to reduce sound and vibration arising in accompaniment with suction/discharge flow velocity variation or pressure pulsation.

A screw compressor of a seventh aspect of the invention is the screw compressor of the sixth aspect of the invention, wherein an unbalanced load acts on a compression chamber that suctions from one side of the screw rotor and is formed in the flutes, which results in that an unbalanced load acts on the screw rotor.

Here, an unbalanced load acts on a compression chamber that suctions refrigerant from one side of the screw rotor and is formed in the flutes, which results in that an unbalanced load acts on the screw rotor, so switching of the axial load of the screw rotor accompanying changes in the gas loads inside the compression chamber formed by the screw rotor and the gate rotor can be avoided, and it becomes possible to avoid the occurrence of noise accompanying axial load switching.

A screw compressor of an eighth aspect of the invention is the screw compressor of the sixth aspect of the invention, wherein an unbalanced load acts on the screw rotor because of its own weight.

Here, an unbalanced load acts on the screw rotor because of its own weight, so a downward unbalanced load acts because of the own weight of the screw rotor, whereby axial load switching accompanying changes in the gas loads inside the compression chamber can be avoided without incurring a special cost increase, and it becomes possible to avoid the occurrence of noise accompanying axial load switching.

A screw compressor of a ninth aspect of the invention is the screw compressor of the sixth aspect of the invention, further comprising a casing that houses the screw rotor. Moreover, the screw compressor is equipped with two pieces of the gate rotors. Suction cut positions corresponding to the two gate rotors in a space portion of the casing are arranged asymmetrically with respect to a centerline of the space portion of the casing. Thus, an unbalanced load acts on the screw rotor.

Here, the screw compressor further comprises a casing that houses the screw rotor, wherein the screw compressor is equipped with two pieces of the gate rotors, and an unbalanced load acts on the screw rotor as a result of suction cut positions corresponding to the two gate rotors in a space portion of the casing being arranged asymmetrically with respect to a centerline of the space portion of the casing. For this reason, switching of the axial load of the screw rotor accompanying changes in the gas loads inside the compression chambers formed by the screw rotor and the gate rotors can be avoided, and it becomes possible to avoid the occurrence of noise accompanying axial load switching.

A screw compressor of a tenth aspect of the invention is the screw compressor of the sixth aspect of the invention, wherein the screw compressor is equipped with two pieces of the gate rotors. The two gate rotors are arranged asymmetrically with respect to a center of rotation of the screw rotor, whereby an unbalanced load acts on the screw rotor.

Here, the screw compressor is equipped with two pieces of the gate rotors, and an unbalanced load acts on the screw rotor as a result of the two gate rotors being arranged asymmetrically with respect to a center of rotation of the screw rotor, so switching of the axial load of the screw rotor accompanying changes in the gas loads inside the compression chambers formed by the screw rotor and the gate rotors can be avoided, and it becomes possible to avoid the occurrence of noise accompanying axial load switching.

A screw compressor of an eleventh aspect of the invention is the screw compressor of the sixth aspect of the invention, wherein the gate rotor has plural teeth that are the plural projections. At least one of the teeth is arranged non-uniformly with respect to the other teeth in the circumferential direction of the second rotating shaft that is a rotating shaft of the gate rotor by shifting and arranging a lateral seal portion of a side surface of the teeth in the width direction of the teeth.

Here, the gate rotor has plural teeth that are the plural projections, and at least one of the teeth is arranged non-uniformly with respect to the other teeth in the circumferential direction of the second rotating shaft that is a rotating shaft of the gate rotor by shifting and arranging a lateral seal portion of a side surface of the teeth in the width direction of the teeth, so a volume change per compression chamber at the time of suction/compression/discharge can be imparted, so it is possible to further reduce sound and vibration accompanying compression torque variation. Moreover, it is possible to further reduce sound and vibration arising in accompaniment with suction/discharge flow velocity variation or pressure pulsation. Further, the plural compression chambers are given an irregular pitch while undergoing different volume changes by shifting and arranging the lateral seal portion of the side surface of the tooth in the width direction of the tooth, so it is possible to more easily impart irregularity of the compression operation, and the effect of vibration reduction can be obtained easily.

ADVANTAGEOUS EFFECTS OF THE INVENTION

According to the first aspect of the invention, compression torque variation that had arisen in the conventional screw whose teeth and flutes are arranged equidistantly and torque pulsation resulting from compression torque variation can be significantly reduced. As a result, sound and vibration accompanying compression torque variation can be reduced. Moreover, sound and vibration arising in accompaniment with suction/discharge flow velocity variation or pressure pulsation can be reduced.

According to the second aspect of the invention, axial load switching accompanying changes in the gas load inside the compression chamber formed by the first meshing body and the second meshing body can be avoided, and the occurrence of noise accompanying axial load switching can be avoided.

According to the third aspect of the invention, sound and vibration can be reliably reduced, and design is easy.

According to the fourth aspect of the invention, rotational centrifugal force can be balanced, and so there can be provided an even lower vibration screw compressor.

According to the fifth aspect of the invention, sound and vibration can be reduced.

According to the sixth aspect of the invention, significantly reducing compression torque variation can be achieved even in a single screw compressor, and sound and vibration arising in accompaniment with suction/discharge flow velocity variation or pressure pulsation can be reduced.

According to the seventh aspect of the invention, switching of the axial load of the screw rotor accompanying changes in the gas loads inside the compression chamber formed by the screw rotor and the gate rotor can be avoided, and the occurrence of noise accompanying axial load switching can be avoided.

According to the eighth aspect of the invention, axial load switching accompanying changes in the gas loads inside the compression chamber can be avoided without incurring a special cost increase, and the occurrence of noise accompanying axial load switching can be avoided.

According to the ninth aspect of the invention, switching of the axial load of the screw rotor accompanying changes in the gas loads inside the compression chambers formed by the screw rotor and the gate rotors can be avoided, and the occurrence of noise accompanying axial load switching can be avoided.

According to the tenth aspect of the invention, switching of the axial load of the screw rotor accompanying changes in the gas loads inside the compression chambers formed by the screw rotor and the gate rotors can be avoided, and the occurrence of noise accompanying axial load switching can be avoided.

According to the eleventh aspect of the invention, a volume change per compression chamber at the time of suction/compression/discharge can be imparted, so sound and vibration accompanying compression torque variation can be further reduced. Moreover, sound and vibration arising in accompaniment with suction/discharge flow velocity variation or pressure pulsation can be further reduced. Moreover, the plural compression chambers are given an irregular pitch while undergoing different volume changes, so irregularity of the compression operation can be imparted more easily and, as a result, the effect of vibration reduction can be obtained easily.

BRIEF DESCRIPTION OF THE DRAWINGS

FIG. 4(*a*) is a plain view of the screw rotor and the gate rotors. FIG. 4(*b*) is a view of the screw rotor and the gate rotors seen from the axial direction of the screw rotor.

DETAILED DESCRIPTION OF EMBODIMENT(S)

<First Embodiment>

Figure 1:
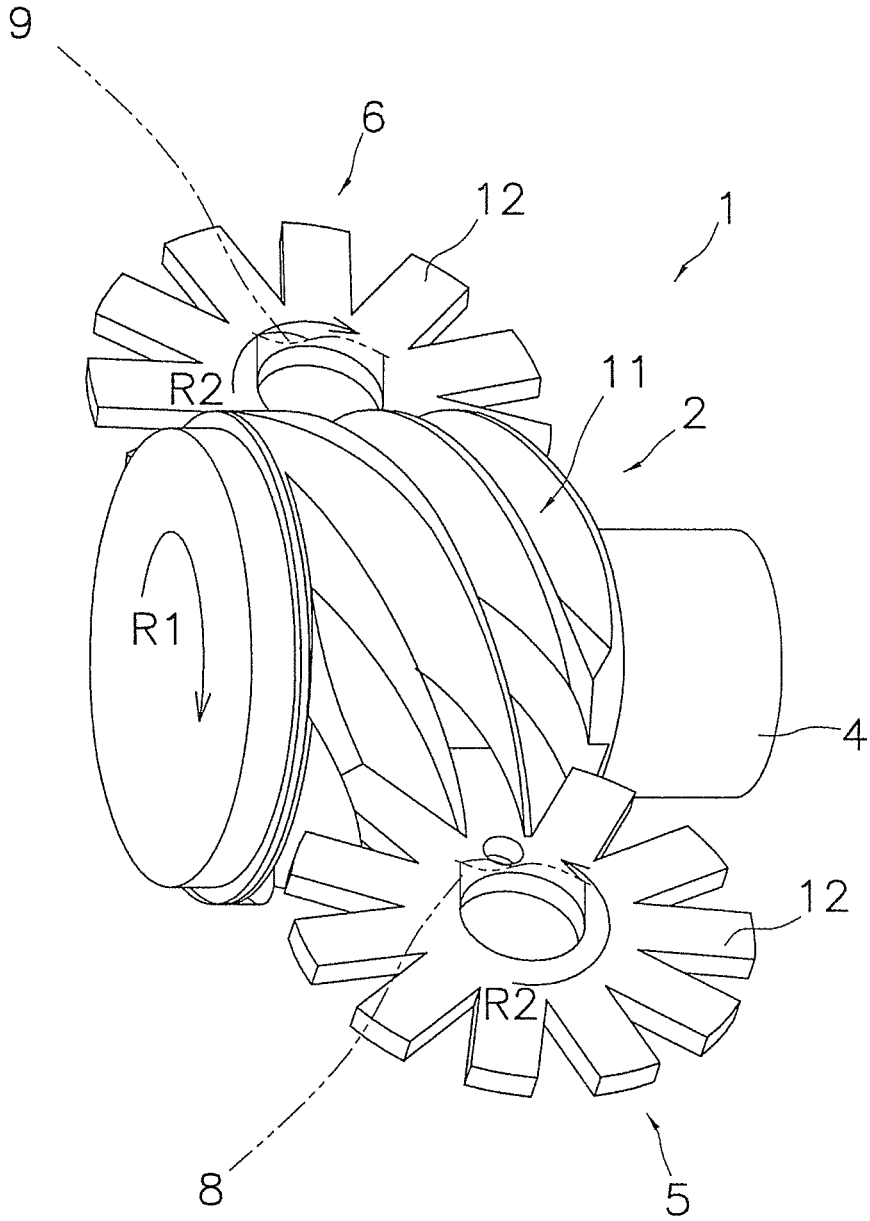
FIG. 1 is a configuration diagram of main portions of a single screw compressor pertaining to a first embodiment of the present invention.

Next, embodiments of a screw compressor of the present invention will be described with reference to the drawings.

<Configuration of Single Screw Compressor 1>

A single screw compressor 1 shown in FIGS. 1 to 4 is equipped with one screw rotor 2, a casing 3 that houses the screw rotor 2, a shaft 4 that becomes a rotating shaft of the screw rotor 2, two gate rotors 5 and 6, a thrust bearing 7 that supports the screw rotor 2 from the axial direction of the screw rotor 2, and rotating shafts 8 and 9 for the two gate rotors 5 and 6.

Here, the screw rotor 2 corresponds to a first meshing body of the present invention. Further, each of the two gate rotors 5 and 6 corresponds to a second meshing body of the present invention. Further, teeth 12 of the gate rotors 5 and 6 correspond to projections of the present invention. The shaft 4 corresponds to a first rotating shaft of the present invention. Each of the rotating shafts 8 and 9 corresponds to a second rotating shaft of the present invention.

The screw rotor 2 is a circular column-shaped rotor having plural helical flutes 11 in its outer peripheral surface. The screw rotor 2 is capable of rotating inside the casing 3 integrally with the shaft 4. The screw rotor 2 is supported by the thrust bearing 7 from a direction (the opposite direction of a gas suction direction F1) leading from a discharge side toward a suction side along the axial direction of the screw rotor 2. One end of the shaft 4 is joined to the screw rotor 2, and the other end of the shaft 4 is coupled to a drive motor (not shown) outside the casing 3.

The casing 3 is a circular cylinder-shaped member and houses the screw rotor 2 and the shaft 4 such that they may freely rotate.

The two gate rotors—that is, the first gate rotor 5 and the second gate rotor 6—are both rotors having plural teeth 12 that mesh with the flutes 11 in the screw rotor 2, and the two gate rotors 5 and 6 are capable of rotating about the rotating shaft 8 and 9, which are substantially perpendicular to the shaft 4 that is the rotating shaft of the screw rotor 2. The teeth 12 of the gate rotor 5 are capable of meshing with the helical flutes 11 in the screw rotor 2 inside the casing 3 through a slit 14 formed in the casing 3. The two gate rotors 5 and 6 are arranged so as to be bilaterally symmetrical with respect to the center of rotation of the screw rotor 2. It will be noted that the gate rotors 5 and 6 may also be arranged so as to be vertically symmetrical.

When the screw rotor 2 rotates, the plural teeth 12 of the first gate rotor 5 and the second gate rotor 6 can sequentially mesh with the plural flutes 11.

Further, in the outer peripheral surface of the casing 3, one discharge port 10 each for discharging refrigerant that has been compressed inside the casing 3 is formed in correspondence to the first gate rotor 5 and the second gate rotor 6.

These discharge ports 10 are formed in appropriate positions in the outer peripheral surface of the casing 3 such that they become capable of being communicated with the flutes 11 in the outer peripheral surface of the screw rotor 2 when the screw rotor 2 rotates.

At least one tooth 12 of the plural teeth 12 of the first and second gate rotors 5 and 6 is arranged non-uniformly with respect to the other teeth 12 in the circumferential direction of the rotating shafts 8 and 9.

Figure 4A:
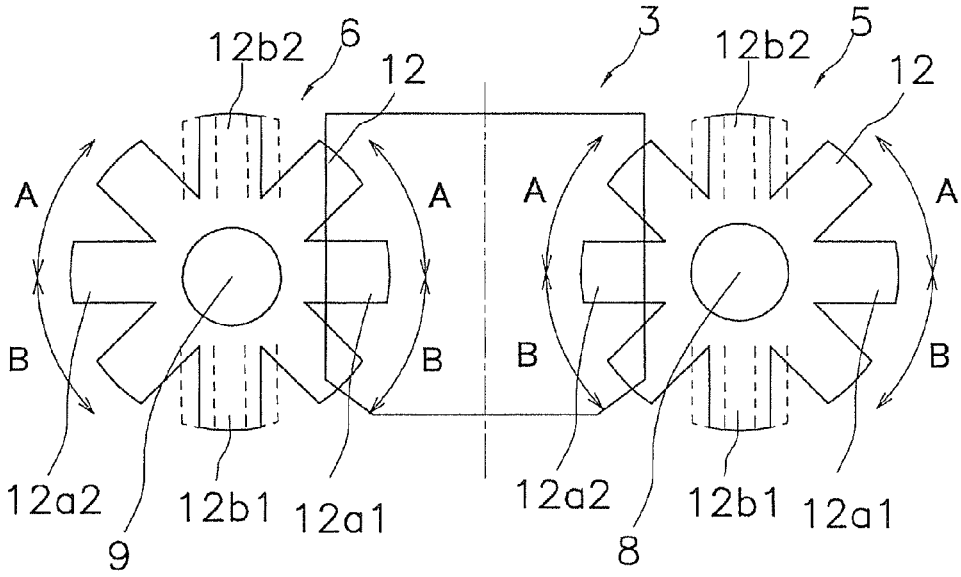
FIG. 4(*a*) and FIG. 4(*b*) are arrangement diagrams of plural teeth showing a non-uniform arrangement of teeth of the gate rotors of FIG. 1.
Figure 4B:
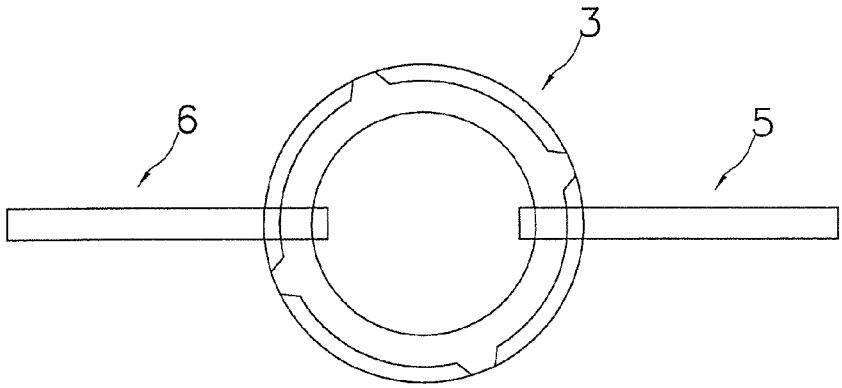

For example, as shown in FIG. 4(*a*), of the plural teeth 12 of the first gate rotor 5 and the second gate rotor 6, teeth 12*a*1 and 12*a*2 that are arranged non-uniformly by changing the angle of the teeth are arranged symmetrically with respect to the rotating shafts 8 and 9 of the gate rotors 5 and 6. Opening angles A and B between these teeth 12*a*1 and 12*a*2 and both adjacent teeth 12 are different. Further, as another example of the non-uniform arrangement, teeth 12*b*1 and 12*b*2 that are arranged non-uniformly by shifting lateral seal portions of side surfaces of the teeth 12 in the width direction of the teeth may also be disposed symmetrically with respect to the rotating shafts 8 and 9 of the gate rotors 5 and 6. It will be noted that, in regard to the non-uniform arrangement of the teeth 12 of the present invention, there may be employed either method, or both methods, of changing the angle of the teeth or shifting lateral seal portions of side surfaces of the teeth in the width direction of the teeth as described above.

The plural helical flutes 11 in the screw rotor 2 are arranged, so as to be meshable with the plural teeth 12, in the circumferential direction of the shaft 4.

Because of the above-described non-uniform arrangement of the teeth 12, it is possible to significantly reduce compression torque variation that had arisen in the conventional screw whose teeth and flutes are disposed equidistantly and torque pulsation resulting from compression torque variation, and together with that it is possible to reduce sound and vibration.

Further, the screw rotor 2 and the gate rotors 5 and 6 are balanced in weight such that an unbalanced load acts thereon in a direction that is different from the direction in which the shaft 4 extends and in which the rotating shafts 8 and 9 extend respectively. It will be noted that the single screw compressor may also be configured such that an unbalanced load acts on just either one of the screw rotor 2 or the gate rotors 5 and 6.

For example, the screw rotor 2 may be configured such that an unbalanced load acts thereon in the vertical direction because of its own weight.

Figure 3:
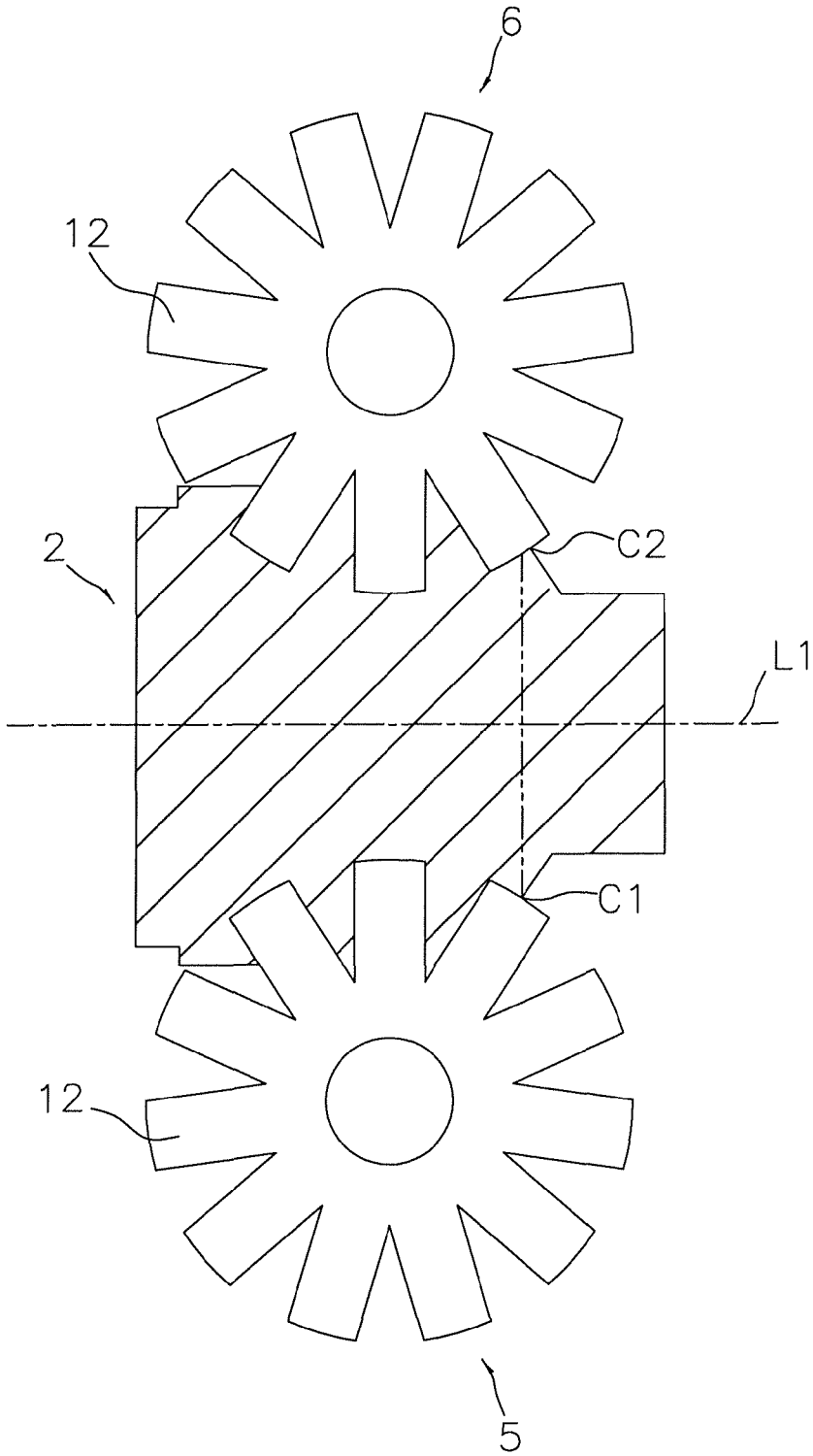
FIG. 3 is a cross-sectional view showing positions of suction cut portions of gate rotors and a screw rotor of FIG. 1.

Further, as shown in FIG. 3, suction cut positions C1 and C3 (see FIG. 3) corresponding to the two gate rotors 5 and 6 in a space portion of the casing 3 are arranged asymmetrically with respect to a centerline L1 of the space portion of the casing 3 (in FIG. 3, arranged so as to be shifted in the direction in which the centerline L1 extends). Thus, an unbalanced load acts on the screw rotor 2 and the two gate rotors 5 and 6.

In this manner, because an unbalanced load acts on the screw rotor 2 and the two gate rotors 5 and 6, switching of the axial load of the screw rotor 2 (that is, a load acting on the rotating shaft of the screw rotor 2) accompanying changes in the gas loads inside the compression chambers formed by the flutes 11 in the screw rotor 2 and the teeth 12 of the gate rotors 5 and 6 can be avoided, and it becomes possible to avoid the occurrence of noise accompanying axial load switching.

The number of the helical flutes 11 has a relationship where it has a common divisor other than 1 with the number of the teeth 12 of the gate rotors 5 and 6. For example, this means an integral multiple relationship (e.g., a relationship where the number of the teeth 12 is two times, three times, four times, etc. the number of the flutes 11) or a relationship where, even if it is not an integral multiple, the flutes 11 and the teeth 12 mesh every predetermined number of rotations (e.g., when the screw rotor 2 rotates five times, the gate rotors 5 and 6 rotate seven times). Thus, the flutes 11 and the teeth 12 have a structure where the non-uniformly arranged tooth 12 is capable of reliably meshing with the corresponding predetermined flute 11. Consequently, sound and vibration can be reliably reduced, and design of the screw rotor 2 and the gate rotors 5 and 6 becomes easy.

Further, as shown in FIG. 4, at least the set of the non-uniformly arranged teeth 12*a*1 and 12*a*2 or the set of the non-uniformly arranged teeth 12*b*1 and 12*b*2 of the plural teeth 12 of the gate rotors 5 and 6 is arranged symmetrically with respect to the rotating shafts 8 and 9. Because of this configuration, it becomes possible to balance rotational centrifugal force.

Moreover, setting of the center of gravity is done such that the center of gravity of the screw rotor 2 and the gate rotors 5 and 6 in a cross section perpendicular to the direction of the shaft 4 and/or the rotating shafts 8 and 9, substantially coincides with the center of the rotation of the shaft 4 and/or the rotating shafts 8 and 9 respectively. Consequently, there is no longer any misalignment between the center of gravity and the center of rotation of the screw rotor 2 and the gate rotors 5 and 6, so it becomes possible to reduce sound and vibration.

It will be noted that setting of the center of gravity may also be done such that the center of gravity of either one of the screw rotor 2 or the gate rotors 5 and 6 in a cross section perpendicular to the direction of the shaft 4 or the rotating shafts 8 and 9, coincides with the center of the rotation of the shaft 4 or the rotating shafts 8 and 9 respectively.

<Explanation of the Operation of the Single Screw Compressor 1>

The single screw compressor 1 shown in FIGS. 1 to 3 compresses gas as described below.

First, when the shaft 4 receives rotational drive force from the motor (not shown) outside the casing 3, the screw rotor 2 rotates in the direction of arrow R1 (see FIG. 1). At this time, the two gate rotors 5 and 6 meshing with the helical flutes 11 in the screw rotor 2 rotate in the direction of arrows R2 as a result of their teeth 12 being pushed by the inner walls of the helical flutes 11. At this time, on the near side of the screw rotor 2 in FIGS. 1 and 2, the volume of the near-side compression chamber partitioned and formed by the inner surface of the casing 3, the flutes 11 in the screw rotor 2 and the teeth 12 of the gate rotor 5 decreases. Together with that, on the far side of the screw rotor 2, the volume of the far-side compression chamber partitioned and formed by the inner surface of the casing 3, the flutes 11 in the screw rotor 2 and the teeth 12 of the gate rotor 6 decreases.

Figure 2:
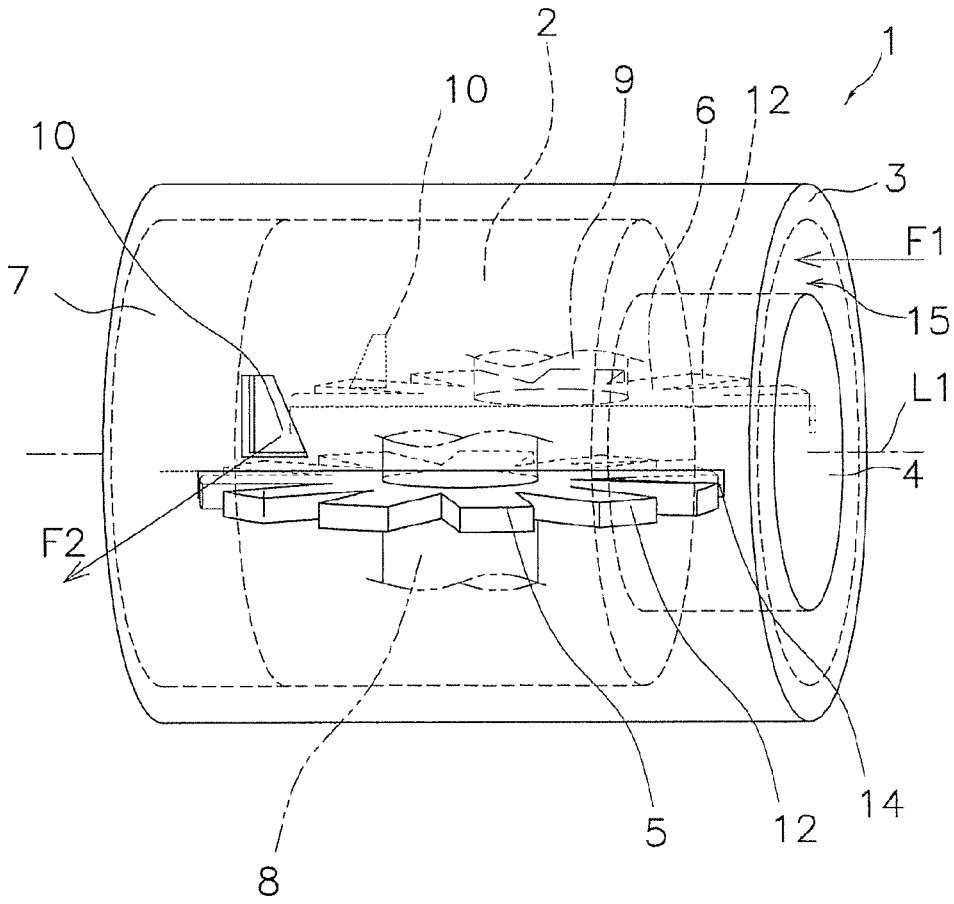
FIG. 2 is a front view of the single screw compressor of FIG. 1.

By utilizing the decrease in the volumes of these two compression chambers, the before-compression refrigerant F1 (see FIG. 2) that is introduced from a suction side opening 15 in the casing 3 is guided to the compression chambers immediately before the flutes 11 and the teeth 12 mesh, the volumes of the compression chambers decrease such that the refrigerant is compressed while the flutes 11 and the teeth 12 are meshing, and thereafter, immediately after the flutes 11 and the teeth 12 disengage, the compressed refrigerant F2 (see FIG. 2) is discharged from the discharge ports 10 that are formed on the near side and on the far side of FIG. 2 and respectively correspond to the gate rotors 5 and 6.

<Characteristics of First Embodiment>

(1)

In the single screw compressor 1 of the first embodiment, at least one tooth 12 (e.g., the teeth 12*a*1, 12*a*2, 12*b*1 and 12*b*2 of FIG. 4(*a*)) of the plural teeth 12 of the first and second gate rotors 5 and 6 is arranged non-uniformly with respect to the other teeth 12 in the circumferential direction of the rotating shafts 8 and 9. Further, the plural helical flutes 11 in the screw rotor 2 are arranged, so as to be meshable with the plural teeth 12, in the circumferential direction of the shaft 4.

Thus, it is possible to significantly reduce compression torque variation that had arisen in the conventional screw whose teeth and flutes are arranged equidistantly and torque pulsation resulting from compression torque variation. As a result, it is possible to reduce sound and vibration accompanying compression torque variation. Moreover, it is possible to reduce sound and vibration arising in accompaniment with suction/discharge flow velocity variation or pressure pulsation.

(2)

In the single screw compressor 1 of the first embodiment, the screw rotor 2 and/or the gate rotors 5 and 6 are/is balanced in weight such that an unbalanced load acts thereon in a direction that is different from the direction in which the shaft 4 extends and/or in which the rotating shafts 8 and 9 extend respectively. Thus, switching of the axial load of the screw rotor 2 accompanying changes in the gas loads inside the compression chambers formed by the screw rotor 2 and the gate rotors 5 and 6 can be avoided, and it becomes possible to avoid the occurrence of noise accompanying axial load switching.

In particular, in the first embodiment, because a downward unbalanced load acts because of the own weight of the screw rotor 2, axial load switching accompanying changes in the gas loads inside the compression chambers can be avoided without incurring a special cost increase, and it becomes possible to avoid the occurrence of noise accompanying axial load switching.

(3)

In the single screw compressor 1 of the first embodiment, the number of the helical flutes 11 has a relationship where it has a common divisor other than 1 with the number of the plural teeth 12. For this reason, the non-uniformly arranged tooth 12 becomes capable of reliably meshing with the corresponding predetermined flute 11. Consequently, sound and vibration can be reliably reduced, and design of the screw rotor 2 and the gate rotors 5 and 6 becomes easy.

(4)

In the single screw compressor 1 of the first embodiment, at least the set of the non-uniformly arranged teeth 12*a*1 and 12*a*2 or the set of the non-uniformly arranged teeth 12*b*1 and 12*b*2 of the plural teeth 12 is arranged symmetrically with respect to the rotating shafts 8 and 9. Thus, rotational centrifugal force can be balanced and, as a result, there can be provided an even lower vibration single screw compressor.

(5)

In the single screw compressor 1 of the first embodiment, setting of the center of gravity is done such that the center of gravity of the screw rotor 2 and/or the gate rotors 5 and 6 in a cross section perpendicular to the direction of the shaft 4 or the rotating shafts 8 and 9, coincides with the center of the rotation of the shaft 4 or the rotating shafts 8 and 9 respectively. Thus, sound and vibration can be reduced.

(6)

In the first embodiment, the single screw compressor 1, where the first meshing body is the screw rotor 2 and the second meshing body is the two gate rotors 5 and 6, is used as the screw compressor of the present invention. In this single screw compressor 1 also, at least one tooth 12 of the plural teeth 12 of the first and second gate rotors 5 and 6 is arranged non-uniformly with respect to the other teeth 12 in the circumferential direction of the rotating shafts 8 and 9, whereby it becomes possible to achieve significantly reducing compression torque variation. Moreover, it is possible to reduce sound and vibration arising in accompaniment with suction/discharge flow velocity variation or pressure pulsation.

(7)

In the first embodiment, an unbalanced load acts on the screw rotor 2 because of the own weight of the screw rotor 2, so switching of the axial load of the screw rotor 2 accompanying changes in the gas loads inside the compression chambers formed by the screw rotor 2 and the gate rotors 5 and 6 can be avoided, and it becomes possible to avoid the occurrence of noise accompanying axial load switching.

(8)

In the first embodiment, an unbalanced load acts on the screw rotor 2 because the suction cut portions C1 and C2 corresponding to the two gate rotors 5 and 6 in the space portion of the casing 3 are arranged asymmetrically with respect to the centerline L1 of the space portion of the casing 3 (e.g., arranged so as to be shifted in the direction in which the centerline L1 extends), so switching of the axial load of the screw rotor 2 accompanying changes in the gas loads inside the compression chambers formed by the screw rotor 2 and the gate rotors 5 and 6 can be avoided, and it becomes possible to avoid the occurrence of noise accompanying axial load switching.

(9)

In the first embodiment, the teeth 12*b*1 and 12*b*2 of the plural teeth 12 of the gate rotors 5 and 6 are arranged non-uniformly with respect to the other teeth 12 in the circumferential direction of the rotating shafts 8 and 9 of the gate rotors 5 and 6 by shifting and arranging lateral seal portions of side surfaces of the teeth in the width direction of the teeth, so a volume change per compression chamber at the time of suction/compression/discharge can be imparted, so it is possible to further reduce sound and vibration accompanying compression torque variation. Moreover, it is possible to further reduce sound and vibration arising in accompaniment with suction/discharge flow velocity variation or pressure pulsation.

Here, in regard to the gate rotors 5 and 6, when the pitch of the teeth 12*a*1 and 12*a*2 are made irregular in the rotation direction angle by changing their angle in the circumferential direction of the second rotating shafts 8 and 9, the plural compression chambers are made irregular in terms of angle while undergoing the same volume change. On the other hand, as mentioned above, the teeth 12*b*1 and 12*b*2 are arranged by shifting lateral seal portions of side surfaces of the teeth in the width direction of the teeth, whereby the plural compression chambers are given an irregular pitch while undergoing different volume changes. Consequently, in comparison to when the teeth 12*a*1 and 12*a*2 are arranged by changing their angle in the circumferential direction of the second rotating shafts 8 and 9, it is possible to more easily impart irregularity of the compression operation, and the effect of vibration reduction can be obtained easily.

It will be noted that, because the teeth 12*a*1 and 12*a*2 of the first embodiment are arranged by shifting lateral seal portions in the width direction of the teeth and are arranged by changing their angle in the circumferential direction of the second rotating shafts 8 and 9, it is possible to even more easily impart irregularity of the compression operation, and the effect of vibration reduction can be obtained more easily.

(10)

In the first embodiment, the teeth 12*a*1 and 12*a*2 of the plural teeth 12 of the gate rotors 5 and 6 are arranged non-uniformly with respect to the other teeth 12 in the circumferential direction of the second rotating shafts 8 and 9 by arranging the teeth 12*a*1 and 12*a*2 by changing their angle in the circumferential direction of the second rotating shafts 8 and 9, so a volume change per compression chamber at the time of suction/compression/discharge can be imparted, so it is possible to further reduce sound and vibration accompanying compression torque variation. Moreover, it is possible to further reduce sound and vibration arising in accompaniment with suction/discharge flow velocity variation or pressure pulsation.

Moreover, because it suffices simply to change the angle pitch of the teeth 12*a*1 and 12*a*2 of the plural teeth 12 and manufacture the gate rotors, it is possible to easily manufacture the gate rotors utilizing a conventional tooth processing machine.

<Modifications of First Embodiment>

(A)

In the above-described first embodiment, the two gate rotors 5 and 6 are arranged so as to be bilaterally symmetrical with respect to the center of rotation of the screw rotor 2, but the present invention is not limited to this.

As a modification of the first embodiment, for example, the two gate rotors 5 and 6 may also be arranged asymmetrically about the circumferential direction of the screw rotor 2 with respect to the center of rotation of the screw rotor 2 such that an unbalanced load acts on the screw rotor 2. Specifically, because the compression chambers respectively formed by the asymmetrically arranged gate rotors 5 and 6 are also arranged asymmetrically, an unbalanced load comes to act on the screw rotor 2 because of the gas loads in the asymmetrically arranged compression chambers. For this reason, switching of the axial load of the screw rotor 2 accompanying changes in the gas loads inside the compression chambers formed by the screw rotor 2 and the gate rotors 5 and 6 can be avoided, and it becomes possible to avoid the occurrence of noise accompanying axial load switching.

(B)

In the above-described first embodiment, the single screw compressor 1 equipped with the two gate rotors 5 and 6 has been taken as an example and described, but the present invention is not limited to this and may also be a single screw compressor 1 equipped with only the one gate rotor 5. The other configurations of the screw rotor 2 and the casing 3 are the same as the configurations of the first embodiment.

In this case also, like the first embodiment, it suffices for at least one tooth 12 of the plural teeth 12 of the gate rotor 5 to be arranged non-uniformly with respect to the other teeth 12 in the circumferential direction of the rotating shaft 8 in order to reduce compression torque variation.

Figure 5:
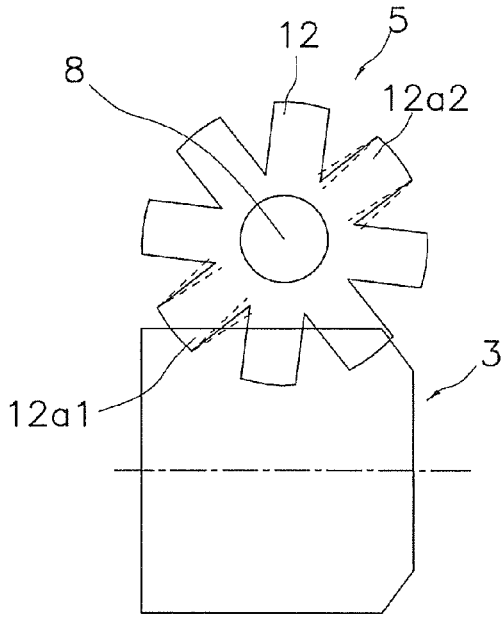
FIG. 5 is a configuration diagram of main portions of a single screw compressor equipped with one gate rotor pertaining to a modification of the first embodiment of the present invention.

For example, as shown in FIG. 5, of the plural teeth 12 of the gate rotor 5, it suffices for the teeth 12*a*1 and 12*a*2 that are arranged non-uniformly by changing the angle of the teeth to be arranged symmetrically with respect to the rotating shaft 8 of the gate rotor 5.

Figure 6:
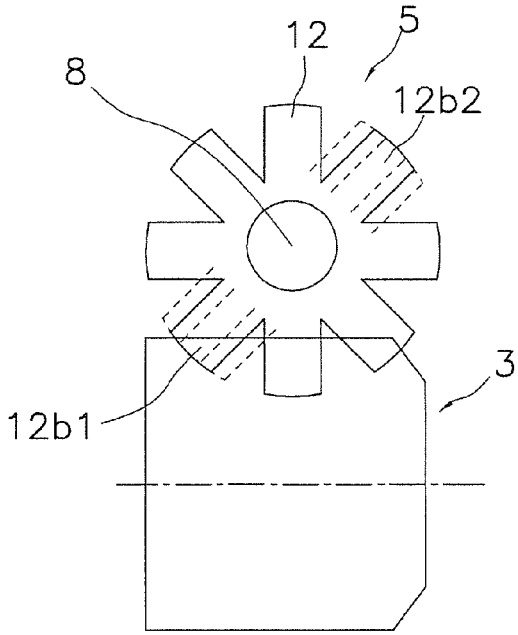
FIG. 6 is a configuration diagram of main portions of a single screw compressor equipped with one gate rotor pertaining to another modification of the first embodiment of the present invention.

Further, as another example, as shown in FIG. 6, it also suffices for the teeth 12*b*1 and 12*b*2 that are arranged non-uniformly by shifting the teeth 12 in the width direction to be arranged symmetrically with respect to the rotating shaft 8 of the gate rotor 5. It will be noted that, as described above, either changing the angle of the teeth or shifting the teeth in the width direction of the teeth may be employed.

(C)

Further, in the case of the single screw compressor 1 equipped with the single gate rotor 5 shown in FIGS. 5 and 6 such as in the above-described modification (B), a compression chamber becomes formed only on one side of the screw rotor 2 by the flutes 11 in the screw rotor 2, the teeth 12 of the gate rotor 5 and the casing 3. For this reason, the structure results in that an unbalanced load acts on the compression chamber that suctions refrigerant from one side of the screw rotor 2 and is formed in the flutes 11. For this reason, an unbalanced load comes to act on the screw rotor 2 because of the gas load on the one side only in the compression chamber. For this reason, switching of the axial load of the screw rotor 2 accompanying changes in the gas load inside the compression chamber formed by the screw rotor 2 and the gate rotor 5 can be avoided, and it becomes possible to avoid the occurrence of noise accompanying axial load switching.

<Second Embodiment>

Next, a twin screw compressor 101 that is one embodiment of the screw compressor of the present invention will be described with reference to the drawings.

<Configuration of Twin Screw Compressor 101>

Figure 7:
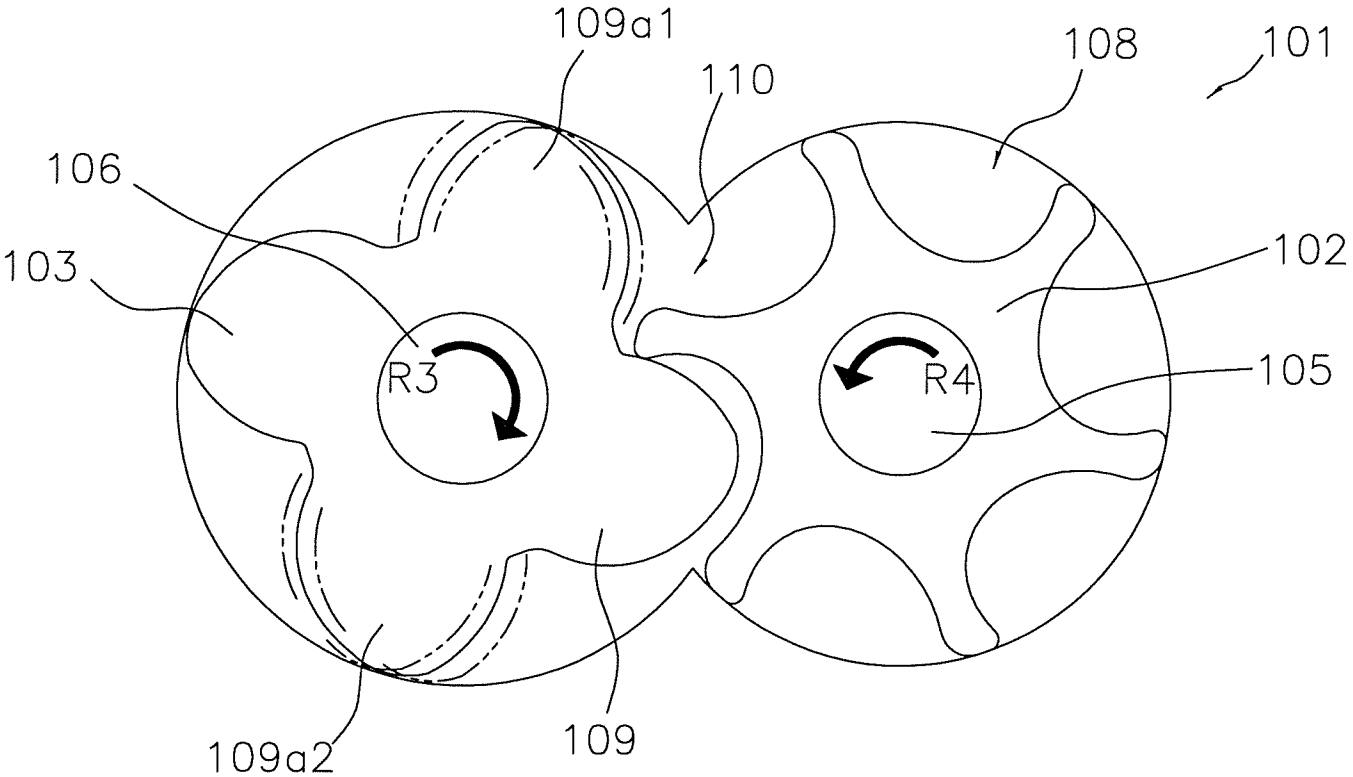
FIG. 7 is a diagram showing main portions of a twin screw compressor pertaining to a second embodiment of the present invention as seen from the axial direction of first and second shafts.
Figure 8:
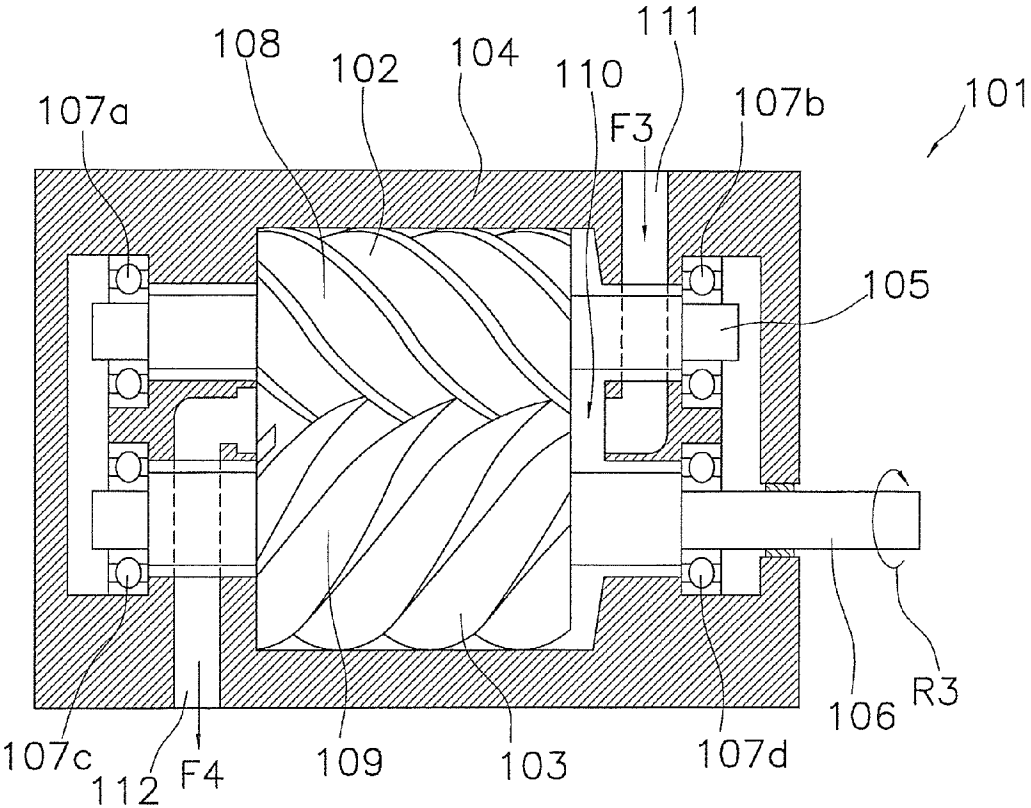
FIG. 8 is a plan configuration diagram of a state where the main portions of the twin screw compressor of FIG. 7 are housed inside a casing.

The twin screw compressor 101 shown in FIGS. 7 and 8 is equipped with a female rotor 102, a male rotor 103, a casing 104 that houses the female rotor 102 and the male rotor 103, a first shaft 105 that becomes a rotating shaft of the female rotor 102, a second shaft 106 that becomes a rotating shaft of the male rotor 103, and roller bearings 107*a*, 107*b*, 107*c* and 107*d* that support the first shaft 105 and the second shaft 106 such that they may freely rotate inside the casing 104.

The female rotor 102 and the male rotor 103 shown in FIGS. 7 and 8 are arranged horizontally, but they may also be arranged vertically.

Here, the female rotor 102 corresponds to a first meshing body of the present invention. Further, the male rotor 103 corresponds to a second meshing body of the present invention. The first shaft 105 corresponds to a first rotating shaft of the present invention. The second shaft 106 corresponds to a second rotating shaft of the present invention.

The female rotor 102 is a circular column-shaped rotor having plural helical flutes 108 in its outer peripheral surface. The female rotor 102 is capable of rotating inside the casing 104 integrally with the first shaft 105. The first shaft 105 is supported by the pair of roller bearings 107*a* and 107*b* such that it may freely rotate.

The male rotor 103 is a circular column-shaped rotor having helical lobes 109 that mesh with the helical flutes 108 in the female rotor 102. The male rotor 103 is capable of rotating inside the casing 104 integrally with the second shaft 106. The second shaft 106 is supported by the pair of roller bearings 107*c* and 107*d* such that it may freely rotate. One end of the second shaft 106 extends outside the casing 104 and is coupled to a drive motor (not shown) outside the casing 104.

The casing 104 is an enclosed enclosure that houses the female rotor 102 and the male rotor 103 such that they may freely rotate. In the casing 104, there are formed a suction port 111 and a discharge port 112 that are communicated with a space portion 110 in which the female rotor 102 and the male rotor 103 are disposed.

As shown in FIG. 7, at least one lobe 109 of the plural lobes 109 of the male rotor 103 is arranged non-uniformly with respect to the other lobes 109 in the circumferential direction of the second shaft 106 in order to reduce compression torque variation.

For example, as shown in FIG. 7, lobes 109*a*1 and 109*a*2 of the plural lobes 109 of the male rotor 103 are arranged non-uniformly by shifting them in their width direction. It will be noted that, in regard to the non-uniform arrangement of the lobes 109 of the present invention, the angle of the lobes 109 may also be changed instead of shifting the lobes 109 in their width direction.

The plural helical flutes 108 in the female rotor 102 are arranged, so as to be meshable with the plural lobes 109, in the circumferential direction of the first shaft 105.

Because of the above-described non-uniform arrangement of the lobes 109, it is possible to significantly reduce compression torque variation that had arisen in the conventional screw whose teeth and flutes are disposed equidistantly and torque pulsation resulting from compression torque variation, and together with that it is possible to reduce sound and vibration.

Further, the female rotor 102 and the male rotor 103 are balanced in weight such that an unbalanced load acts thereon in a direction that is different from the direction in which the first shaft 105 and the second shaft 106 extends respectively. It will be noted that the twin screw compressor may also be configured such that an unbalanced load acts on just either one of the female rotor 102 and the male rotor 103.

For example, the horizontally arranged female rotor 102 and male rotor 103 shown in FIGS. 7 and 8 may be configured such that an unbalanced load acts thereon in the vertical direction because of their own weight.

In this manner, because an unbalanced load acts on the female rotor 102 and the male rotor 103, switching of the axial loads of the female rotor 102 and the male rotor 103 (that is, loads acting on the rotating shafts of the female rotor 102 and the male rotor 103) accompanying changes in the gas load inside the compression chamber formed by the flutes 108 in the female rotor 102 and the lobes 109 of the male rotor 103 can be avoided, and it becomes possible to avoid the occurrence of noise accompanying axial load switching.

The number of the helical flutes 108 has a relationship where it has a common divisor other than 1 with the number of the lobes 109 of the male rotor 103. For example, this means an integral multiple relationship (e.g., a relationship where the number of the lobes 109 is two times, three times, four times, etc. to the number of the flutes 108) or a relationship where, even if it is not an integral multiple, the flutes 108 and the lobes 109 mesh every predetermined number of rotations (e.g., when the female rotor 102 rotates six times, the male rotor 103 rotates four times). Thus, the flutes 108 and the lobes 109 have a structure where each of the non-uniformly arranged lobes 109 is capable of reliably meshing with the corresponding predetermined flute 108. Consequently, sound and vibration can be reliably reduced, and design of the female rotor 102 and the male rotor 103 becomes easy.

Further, as shown in FIG. 7, at least the set of the non-uniformly arranged lobes 109*a*1 and 109*a*2 of the plural lobes 109 of the male rotor 103 is arranged symmetrically with respect to the second shaft 106. Because of this configuration, it becomes possible to balance rotational centrifugal force.

Moreover, setting of the center of gravity is done such that the center of gravity of the female rotor 102 and the male rotor 103 in a cross section perpendicular to the direction of the first shaft 105 and the second shaft 106, coincides with the center of the rotation of the first shaft 105 and the second shaft 106 respectively. Consequently, there is no longer any misalignment between the center of gravity and the center of rotation of the female rotor 102 and the male rotor 103, so it becomes possible to reduce sound and vibration.

<Explanation of the Operation of the Twin Screw Compressor 101>

The twin screw compressor 101 shown in FIGS. 7 and 8 compresses gas as described below.

First, when the second shaft 106 receives rotational drive force from the motor (not shown) outside the casing 104, the male rotor 103 rotates in the direction of arrow R3 (see FIGS. 7 and 8). At this time, the female rotor 102 having the helical flutes 108 that mesh with the lobes 109 of the male rotor 103 rotates in the direction of arrow R4 as a result of the inner walls of the helical flutes 108 being pushed by the lobes 109. At this time, the volume of the compression chamber partitioned and formed by the inner surface of the casing 104, the flutes 108 in the female rotor 102 and the lobes 109 of the male rotor 103 decreases. By utilizing the decrease in the volume of this compression chamber, before-compression refrigerant F3 that is introduced from the suction port 111 in the casing 104, is compressed by the decrease in the volume of the compression chamber while the flutes 108 and the lobes 109 are meshing. Thereafter, the compressed refrigerant F4 is discharged from the discharge port 112.

<Characteristics of Second Embodiment>

(1)

In the twin screw compressor 101 of the second embodiment, at least one lobe 109 (e.g., the lobes 109*a*1 and 109*a*2 of FIG. 7) of the plural lobes 109 of the male rotor 103 is arranged non-uniformly with respect to the other lobes 109 in the circumferential direction of the second shaft 106. Further, the plural helical flutes 108 in the female rotor 102 are arranged, so as to be meshable with the plural lobes 109, in the circumferential direction of the first shaft 105.

Thus, it is possible to significantly reduce compression torque variation that had arisen in the conventional screw whose teeth and flutes are arranged equidistantly and torque pulsation resulting from compression torque variation. As a result, it is possible to reduce sound and vibration accompanying compression torque variation. Moreover, it is possible to reduce sound and vibration arising in accompaniment with suction/discharge flow velocity variation or pressure pulsation.

(2)

In the twin screw compressor 101 of the second embodiment, the female rotor 102 and/or the male rotor 103 are/is balanced in weight such that an unbalanced load acts thereon in a direction that is different from the direction in which the first shaft 105 and/or the second shaft 106 extends respectively. Thus, switching of the axial loads of the female rotor 102 and the male rotor 103 accompanying changes in the gas load inside the compression chamber formed by the female rotor 102 and the male rotor 103 can be avoided, and it becomes possible to avoid the occurrence of noise accompanying axial load switching.

In particular, in the second embodiment, because a downward unbalanced load acts because of the own weight of the female rotor 102 and the male rotor 103, axial load switching accompanying changes in the gas load inside the compression chamber can be avoided without incurring a special cost increase, and it becomes possible to avoid the occurrence of noise accompanying axial load switching.

(3)

In the twin screw compressor 101 of the second embodiment, the number of the helical flutes 108 has a relationship where it has a common divisor other than 1 with the number of the plural lobes 109. For this reason, each of the non-uniformly arranged lobes 109 becomes capable of reliably meshing with the corresponding predetermined flute 108. Consequently, sound and vibration can be reliably reduced, and design of the female rotor 102 and the male rotor 103 becomes easy.

(4)

In the twin screw compressor 101 of the second embodiment, at least the set of the non-uniformly arranged lobes 109*a*1 and 109*a*2 of the plural lobes 109 is arranged symmetrically with respect to the second rotating shaft 106. Thus, rotational centrifugal force can be balanced and, as a result, there can be provided an even lower vibration twin screw compressor.

(5)

In the twin screw compressor 101 of the first embodiment, setting of the center of gravity is done such that the center of gravity of the female rotor 102 and/or the male rotor 103 in a cross section perpendicular to the direction of the first shaft 105 and/or the second shaft 106, coincides with the center of the rotation of the first shaft 105 and/or the second shaft 106 respectively. Thus, sound and vibration can be reduced.

Industrial Applicability

The present invention is capable of being applied to a single screw compressor, a twin screw compressor and other various screw compressors. In particular, the present invention can be suitably applied to a screw compressor that is built into a chiller or a heat pump. The present invention can also be applied to a variable refrigerant volume (VRV) type compressor.

What is claimed is:

1. A screw compressor comprising:

a first meshing body having a plural number of helical flutes disposed around a first rotating shaft; and a second meshing body having a plural number of projections disposed around a second rotating shaft, at least one of the projections being arranged non-uniformly with respect to the other projections in a circumferential direction of the second rotating shaft, the helical flutes being arranged to be meshable with the plural projections in a circumferential direction of the first rotating shaft, and at least one of the first meshing body and the second meshing body being balanced in weight such that an unbalanced load acts thereon in a direction that is different from a direction in which at least one of the first rotating shaft and the second rotating shaft extends, respectively.

2. The screw compressor according to claim 1, wherein the number of the helical flutes has a common divisor other than 1 with the number of the projections.

3. The screw compressor according to claim 2, wherein more than one of the plural projections is arranged non-uniformly with respect to the other projections in the circumferential direction of the second rotating shaft, and at least the non-uniformly arranged projections of the plural projections are arranged symmetrically with respect to the second rotating shaft.

4. The screw compressor according to claim 2, wherein a center of gravity of at least one of the first meshing body and the second meshing body in a cross section perpendicular to a rotation axis direction of at least one of the first rotating shaft and the second rotating shaft coincides with a center of rotation of at least one of the first rotating shaft and the second rotating shaft, respectively.

5. The screw compressor according to claim 2, wherein the screw compressor is a single screw compressor where the first meshing body is a screw rotor and the second meshing body is a gate rotor.

6. The screw compressor according to claim 1, wherein more than one of the plural projections is arranged non-uniformly with respect to the other projections in the circumferential direction of the second rotating shaft, and at least the non-uniformly arranged projections of the plural projections are arranged symmetrically with respect to the second rotating shaft.

7. The screw compressor according to claim 6, wherein the screw compressor is a single screw compressor where first meshing body is a screw rotor and the second meshing body is a gate rotor.

8. The screw compressor according to claim 1, wherein a center of gravity of at least one of the first meshing body and the second meshing body in a cross section perpendicular to a rotation axis direction of at least one of the first rotating shaft and the second rotating shaft coincides with a center of rotation of at least one of the first rotating shaft and the second rotating shaft, respectively.

9. The screw compressor according to claim 1, wherein the screw compressor is a single screw compressor where the first meshing body is a screw rotor and the second meshing body is agate rotor.

10. A screw compressor comprising:

a first meshing body having a plural number of helical flutes disposed around a first rotating shaft; and a second meshing body having a plural number of projections disposed around a second rotating shaft, at least one of the projections being arranged non-uniformly with respect to the other projections in a circumferential direction of the second rotating shaft, the helical flutes being arranged to be meshable with the plural projections in a circumferential direction of the first rotating shaft, and a center of gravity of at least one of the first meshing body and the second meshing body in a cross section perpendicular to a rotation axis direction of at least one of the first rotating shaft and the second rotating shaft coinciding with a center of rotation of at least one of the first rotating shaft and the second rotating shaft, respectively.

11. The screw compressor according to claim 10, wherein the number of the helical flutes has a common divisor other than 1 with the number of the projections.

12. The screw compressor according to claim 10, wherein the screw compressor is a single screw compressor where the first meshing body is a screw rotor and the second meshing body is a gate rotor.

13. A single screw compressor comprising:

a first meshing body having a plural number of helical flutes disposed around a first rotating shaft the first meshing body being a screw rotor; and a second meshing body having a plural number of projections disposed around a second rotating shaft, the second meshing body being a gate rotor, at least one of the projections being arranged non-uniformly with respect to the other projections in a circumferential direction of the second rotating shaft, the helical flutes being arranged to be meshable with the plural projections in a circumferential direction of the first rotating shaft, and an unbalanced load acting on a compression chamber that suctions from one side of the screw rotor and is formed in the flutes, which results in an unbalanced load acting on the screw rotor.

14. A single screw compressor comprising:

a first meshing body having a plural number of helical flutes disposed around a first rotating shaft, the first meshing body being a screw rotor; and a second meshing body having a plural number of projections disposed around a second rotating shaft, the second meshing body being a gate rotor, at least one of the projections being arranged non-uniformly with respect to the other projections in a circumferential direction of the second rotating shaft, the helical flutes being arranged to be meshable with the plural projections in a circumferential direction of the first rotating shaft, and an unbalanced load acting on the screw rotor because of its own weight.

15. A single screw compressor comprising:

a first meshing body having a plural number of helical flutes disposed around a first rotating shaft, the first meshing body being a screw rotor;

a second meshing body having a plural number of projections disposed around a second rotating shaft, the second meshing body being a gate rotor; and a casing that houses the screw rotor, at least one of the projections being arranged non-uniformly with respect to the other projections in a circumferential direction of the second rotating shaft, the helical flutes being arranged to be meshable with the plural projections in a circumferential direction of the first rotating shaft, and the screw compressor being equipped with two of the gate rotors, and, an unbalanced load acting on the screw rotor as a result of suction cut positions corresponding to the two gate rotors disposed in a space portion of the casing being arranged asymmetrically with respect to a centerline of the space portion of the casing.

16. A single screw compressor comprising:

a first meshing body having a plural number of helical flutes disposed around a first rotating shaft, the first meshing body being a screw rotor; and a second meshing body having a plural number of projections disposed around a second rotating shaft, the second meshing body being a gate rotor, at least one of the projections being arranged non-uniformly with respect to the other projections in a circumferential direction of the second rotating shaft, the helical flutes being arranged to be meshable with the plural projections in a circumferential direction of the first rotating shaft, and the screw compressor being equipped with two of the gate rotors, and an unbalanced load acting on the screw rotor as a result of the two gate rotors being arranged asymmetrically with respect to a center of rotation of the screw rotor.

17. A single screw compressor comprising:

a first meshing body having a plural number of helical flutes disposed around a first rotating shaft, the first meshing body being a screw rotor; and a second meshing body having a plural number of projections disposed around a second rotating shaft, the second meshing body being a gate rotor, at least one of the projections being arranged non-uniformly with respect to the other projections in a circumferential direction of the second rotating shaft, the helical flutes being arranged to be meshable with the plural projections in a circumferential direction of the first rotating shaft, and the gate rotor having plural teeth that are the plural projections, and at least one of the teeth being arranged non-uniformly with respect to the other teeth in the circumferential direction of the second rotating shaft by shifting and arranging a lateral seal portion of a side surface of the teeth in a width direction of the teeth.

* * * * *

UNITED STATES PATENT AND TRADEMARK OFFICE

CERTIFICATE OF CORRECTION

PATENT NO. : 8,439,660 B2
APPLICATION NO. : 12/673280
DATED : May 14, 2013
INVENTOR(S) : Masanori Masuda et al.

It is certified that error appears in the above-identified patent and that said Letters Patent is hereby corrected as shown below:

In the Claims:

Column 16,
Line 23, "first meshing body is a screw rotor and…" should read -- the first meshing body is a screw rotor and… --.

Column 16,
Line 35, "meshing body is agate rotor." should read -- meshing body is a gate rotor. --.

Column 16,
Line 62, "flutes disposed around a first rotating shaft the first" should read -- flutes disposed around a first rotating shaft, the first --.

Column 17,
Line 41, "rotors, and, an unbalanced load acting…" should read -- rotors, and an unbalanced load acting… --.

Signed and Sealed this
Thirtieth Day of July, 2013

Teresa Stanek Rea
*Acting Director of the United States Patent and Trademark Office*